United States Patent [19]

Nishikawa

[11] Patent Number: 5,020,858

[45] Date of Patent: Jun. 4, 1991

[54] METHOD OF AND APPARATUS FOR FORMING AND TRANSPORTING MUD CLOGS

[75] Inventor: Yutaka Nishikawa, Higashimurayama, Japan

[73] Assignee: Toa Corporation, Tokyo, Japan

[21] Appl. No.: 590,534

[22] Filed: Sep. 28, 1990

[30] Foreign Application Priority Data

Sep. 21, 1988 [JP] Japan ..... 63-234841

[51] Int. Cl.[5] ..... E02F 7/06

[52] U.S. Cl. ..... 299/8; 37/57; 37/64; 406/60; 406/108

[58] Field of Search ..... 37/54, 56, 57, 58, 64, 37/66, 67, 68, 70, 77; 406/56, 57, 60, 108; 299/8

[56] References Cited

U.S. PATENT DOCUMENTS 2,346,180 4/1944 Nauman ..... 37/67

3,842,521 10/1974 Faldi ..... 37/57

3,953,077 4/1976 Kulyabko et al. ..... 406/60 X 4,319,782 3/1982 Latimer ..... 299/1

FOREIGN PATENT DOCUMENTS 63-134721 6/1988 Japan .

*Primary Examiner*—Dennis L. Taylor

*Assistant Examiner*—Arlen L. Olsen

*Attorney, Agent, or Firm*—Armstrong, Nikaido, Marmelstein, Kubovcik, and Murray

[57] ABSTRACT

A method of transporting mud, in which mud agitated and fluidized is supplied, while being pressurized by a pressurizing vane, through a check valve to a mud supply portion, and in which pressurizing air is supplied to the mud supply portion in a mud transporting direction to transport the mud in the mud supply pipe by the air pressure. According to this method, the mud can be continuously transported without large discharge noise.

7 Claims, 9 Drawing Sheets

METHOD OF AND APPARATUS FOR FORMING AND TRANSPORTING MUD CLOGS

This application is a continuation of application Ser. No. 392,806 filed Aug. 11, 1989.

BACKGROUND OF THE INVENTION

The present invention relates to a method of and apparatus for transporting earthy material containing water, especially mud or like material at the bottom of bodies of water, in a high concentration of the material and continuously to a prescribed site for disposal.

In recent years, it has been increasingly widely operated to transport earthy material deposited on the bottom of a dam, harbor or river to the prescribed site for disposal of the material. In order to dredge and transport the material deposited on the water bottom efficiently to the site for disposal, it is necessary to reduce the content of water in the material-water mixtures as much as possible and transport the mixtures continuously to the site while a high concentration of the material is maintained.

A variety of methods for dredging and transporting earthy material at the water bottom have been proposed, as exemplified by U.S. Pat. Nos. 2,346,180 and 3,842,521.

In each of these methods, the mud or like material deposited at the bottom of bodies of water is sucked by a nozzle or agitated to increase its fluidity so that it may be sucked and pressurized for transportation.

The problem encountered in case where mixtures of soil and water are to be sucked will be described in the following. Since solids in the mixture are sucked through an inlet port of a pump along the flow of solid-water mixture, in case the mixture has a fluidity near that of water, it is possible to transport the mixture by pumping as in transporting water alone. However, in case the fluidity is relatively low, soil or solids and water can hardly form a homogeneous mixture and there becomes a water channel formed in the mixture, whereby it tends to occur that water is transported in a greater amount than the soil or solids, resulting in that soil or solids are hardly transported.

Therefore, in the art of dredging, important are how to suppress the content of water in mixtures to be dredged and how to continuously transport dredged mixture. The inventor of the present invention has before developed such apparatus by which mud deposited on a water bottom is dredged in a high density or concentration and transported with the content of water suppressed as small as possible, and has proposed the apparatus in Japanese patent application Kokai publication No. 63-134721.

This apparatus is constructed as shown in FIG. 11, and comprises an annular cutter wheel 2 (or bucket wheel) fitted and rotated around a mud tank 1.

In the cutter wheel 2, an axle 3 extending in the center is borne by a bearing 4 with respect to the mud tank 1 so that a pulley 5 fixed at one end of the axle 3 may be driven through a belt 6 by a drive source 7. The cutter wheel 2 is equipped with buckets 8 which project at a spacing from a cylindrical body 2*a* thereof. The bucket 8 is formed in its bottom with an opening 9 which extends in the body 2*a* along the bucket 8, so that mud M excavated by the bucket 8 from the water bottom may be poured into the mud tank 1 from an opening 10 formed in an upper portion of the tank 1.

The axle 3 extending in the center of the mud tank 1 is further equipped with an agitating vane 11 for agitating and fluidizing the mud M poured through the opening 10. The mud tank 1 has its upper half portion covered with a hood 12 which is formed at its top with an air supply port 13 and at its skirt with an air release port as indicated at 13*a* in FIG. 2.

The mud tank 1 is further equipped at its bottom with a connection pipe 14, through which the mud M is conveyed so that it is pressurized by a pressurizing vane 15 and supplied to a pneumatic pump 16.

This pneumatic pump 16 is composed of such as a stop valve 19 for closing a discharge port 18 of a casing 17 accommodating the aforementioned pressurizing vane 15, a mud pipe 21 equipped with a check valve 22, and a pressurized air supply pipe 20.

The pneumatic pump 16 is usually made of three sets which are operative to supply and transport the mud alternately. During the mud transportation, specifically, the air under pressure left in one pneumatic pump 16 is discharged from the pressurized air supply pipe 20, and the mud M in the mud tank 1 is then pressurized by the pressurizing vane 16 and supplied to the pneumatic pump 16. Then, the stop valve 19 is closed, and the air under pressure is supplied from its supply pipe 20 and transported from the mud pipe 21. These steps are alternately accomplished by those three sets of pneumatic pumps.

Since the mud pipe 21 is equipped with the check valve 22, its pressurized air is prevented from flowing back into the pneumatic pump 16 when the air under pressure is to be discharged from the pneumatic pump 16.

However, the mud transporting method using the pneumatic pump 16 is accompanied by the following problems.

(1) In case the mud is to be pumped by using the pneumatic pump, compressed air under high pressure is supplied to the inside of the pump containing the mud, so that the mud may be pneumatically pumped. When the pump is then supplied with the mud, the compressed air has to be discharged at the mud supply step from the pump inside so that serious noises are generated.

(2) In case the mud is to be pumped by using the pneumatic pump, a series of operations of the mud supply to the pneumatic pump—the pressurization by the compressed air—the mud supply are required to use one group of pneumatic pumps. The supply and discharge of the mud to those pumps have to be accomplished intermittently. This makes the mud transportation intermittent with a low efficiency to enlarge the size of the apparatus.

SUMMARY OF THE INVENTION

The present invention has been conceived to solve the drawbacks of the prior art method of transporting water-soil mixtures, especially dredged mud, and it is a first object of the invention to provide a mud transporting method, which is freed from the generation large discharge noise during its mud transportations, and apparatus for carrying out the method.

A second object of the invention is to provide a method of transporting mud continuously and highly efficiently and an apparatus therefor.

A third object is to provide apparatus for transporting mud highly efficiently by excluding solid foreign substances or obstacles such as stones, rubber and plastic members depending on the kind of mud to be dredged.

According to the present invention, dredged mud is mixed and fluidized by means of an agitator or screen. The fluidized mud is pressurized by a pressurizing vane and supplied to a mud supply portion. In this mud supply portion, air under pressure is mixed in a mud supply direction through a check valve so that the mud may be transported in a mud supply pipe.

The mud is either well mixed with air under pressure or separated into mud clumps and pressurized air so that it can be continuously transported in a mud conveyor pipe and continuously discharged from the outlet of the pipe, thus generating no serious discharge noise.

Since the mud transportation can be continuously accomplished, it is far more efficient than that in the case the mud is intermittently transported by making use of pneumatic pumps.

BRIEF DESCRIPTION OF THE DRAWINGS

FIG. 5(*a*) is a top plan view, showing the bottom portion of an obstacle separator of FIG. 5;

DESCRIPTION OF THE PREFERRED EMBODIMENTS

Figure 1:
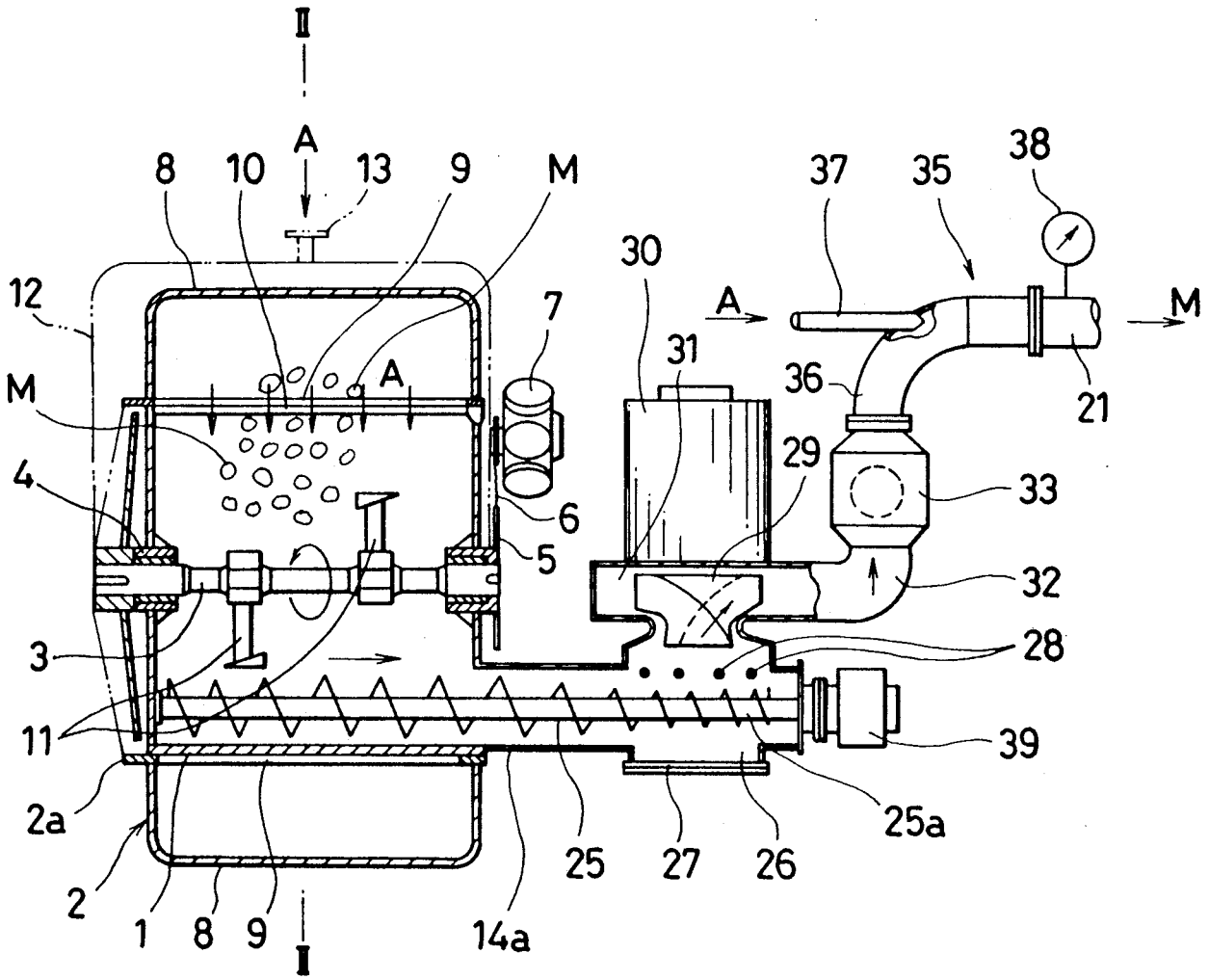
FIG. 1 is a side elevation, showing a dredging apparatus according to a first embodiment of the present invention partially in a cut-away view.
Figure 2:
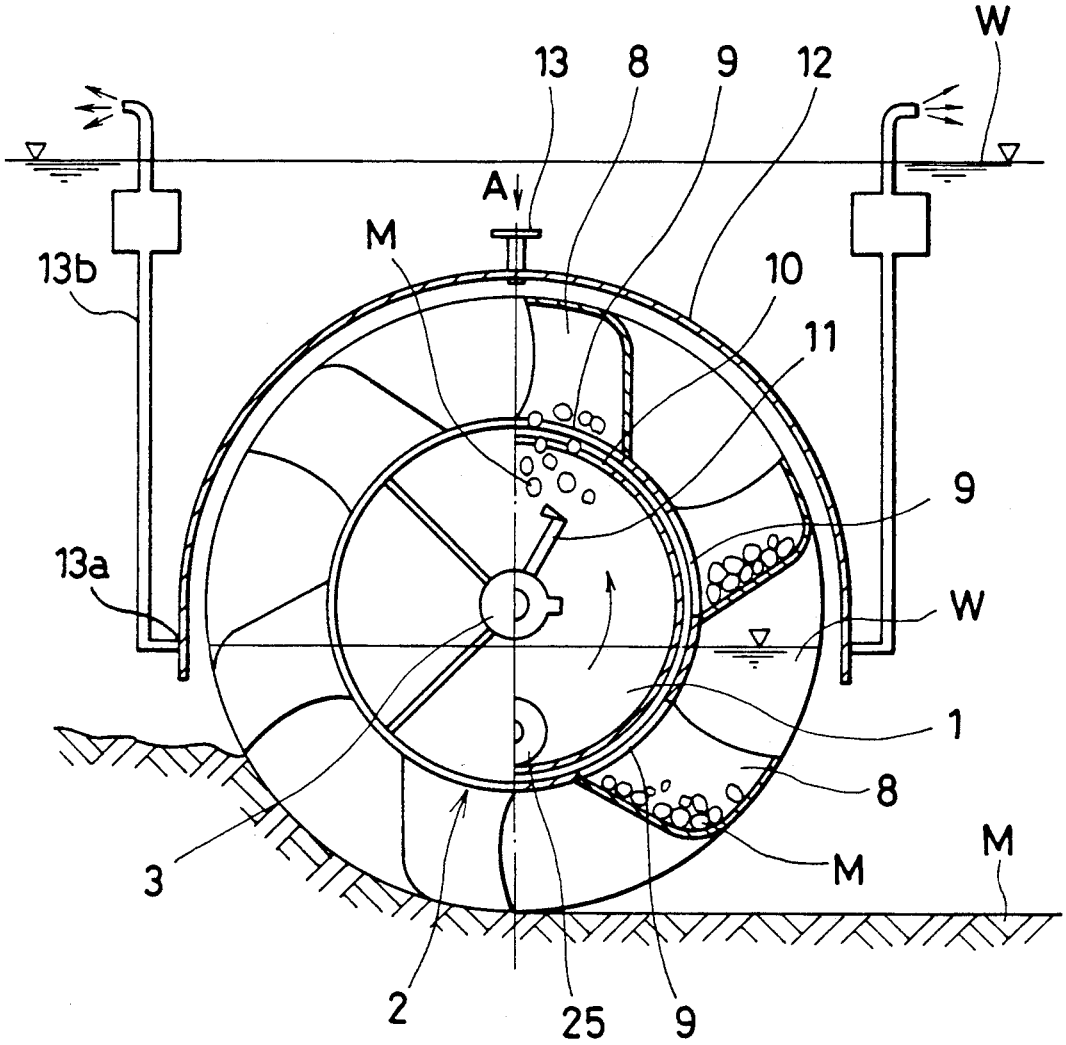
FIG. 2 is a section, showing the dredging apparatus and taken along line II—II of FIG. 1.

FIG. 1 is a partially cut-away front elevation schematically showing a highly dense dredging apparatus according to the first embodiment of the present invention, and FIG. 2 is a section taken along line II—II of FIG. 1.

Figure 11:
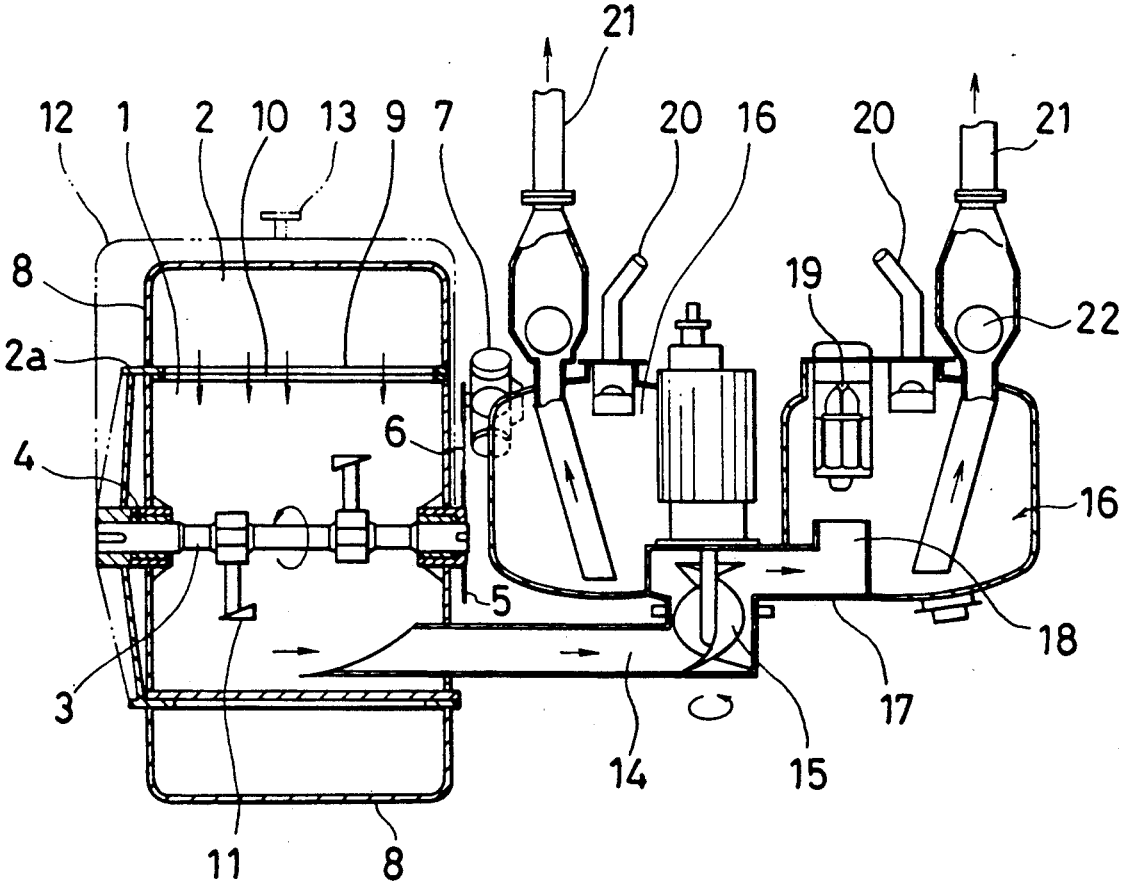
Fig. 11 PRIOR ART
FIG. 11 is a schematic side elevation showing the dredging apparatus of the prior art equipped with the pneumatic pumps, partially in a cut-away view.

This first embodiment is an apparatus which is improved over the technique proposed by us, as shown in FIG. 11, and the dredging mechanism is substantially identical to that of the foregoing apparatus.

This dredging apparatus is constructed such that an annular cutter wheel 2 is fitted and rotated around a mud tank 1. This mud tank 1 has its upper half covered with a hood 12 so that the dredging operation may be accomplished while preventing any invasion of water into the hood 12 by supplying air under pressure from an air supply port 13 formed in the top of the hood 12 and by releasing the excess air from an air release port 13*a* formed in the skirt of the hood 12 through a release pipe 13*b* extending over the water surface.

The mud tank 1 is formed in its bottom with a mud conveyor pipe 14*a* having a screw conveyor 25 built therein and an obstacle separating chamber 26 formed at the leading end of the mud conveyor pipe 14*a*. The obstacle separating chamber 26 can have its bottom opened by a cover 27. The screw conveyor 25 is equipped, at its portion located within the obstacle separating chamber 26, with a screw 25*a* which has a smaller diameter than that of the remaining portion. The obstacle separating chamber 26 is overlaid by an obstacle separator 28, which is made of a plurality of rollers having spiral ridges or grooves formed thereon, and a pressurizing vane 29.

This pressurizing vane 29 is an impeller of a spiral pump for muddy substance transportation and is driven by a motor 30. To the discharge port 32 of a spiral casing 31 accommodating the pressurizing vane 29, there is connected through a check valve 33 a mud pipe 35, which in turn is connected with a mud supply pipe 21.

In this embodiment, the mud pipe 35 is constructed of a bent portion 36 and a nozzle 37 which is disposed at an angle in the bent portion 36 for supplying the air under pressure. A pressure gauge 38 is attached to the mud supply pipe 21 so as to measure the pressure in the pipe.

When the highly dense dredging apparatus thus constructed is to be driven, it is dropped on mud M in the water bottom, as shown in FIG. 2. The air under pressure is supplied to the inside of the hood 12 to discharge the water W from the upper half of the cutter wheel 2, and this wheel 2 is then driven by a drive source 7. The bottom mud M is excavated by buckets 8 which are arranged around the cutter wheel 2 so that it falls into the mud tank 1 through an opening 10 formed in the top of the tank 1 as the cutter wheel 2 is rotated.

Since, in this meanwhile, an agitating vane 11 is rotated in the mud tank 1, the mud M is fluidized and transported by the screw conveyor 25 disposed in the lower portion of the mud tank 1 to the screw conveyor 25*a* of reduced diameter until it is supplied to the obstacle separating chamber 26. This mud M is so treated, while passing through the obstacle separators 28 rotating at a high speed in the obstacle separating chamber 26, that the obstacles in the mud M such as rope, rubber, film, cloth or stone as will obstruct the air mixture pumping are removed and accumulated in the bottom of the obstacle separating chamber 26.

If the screw conveyor 25*a* is clogged therearound with the obstacles (or foreign substances) such as rope or film, its motor 39 has its required torque raised. Thus, the clogging with more than allowable obstacles is detected in terms of the current change of the motor 39, and the operation of the dredging apparatus is interrupted for a while to extract the obstacles such as dust.

The mud M thus cleared of the obstacles is pressurized by the vane 29 of the spiral pump and is supplied to the mud pipe 35. The mud M thus agitated and fluidized in the mud pipe 35 is mixed with the pressurized air A coming from the nozzle 37 so that it is transported through the mud supply pipe 21 to the site of disposal by the pressurization of the vane 29 and the pressurized air A.

The observation of the pressure gauge 38 attached to the mud supply pipe 21 has confirmed that the pressure in the pipe is periodically pulsating. Therefore, the mud supply pipe 21 is made partially transparent with glass to observe the mud being transported. This observation has revealed that the mud clogs the mud supply pipe 21 and that its clumps are pushed with an interval by the pressurized air.

If the mud supply pipe 21 is assumed to be a cylinder, the mud clump corresponds to a kind of piston, and the compressed air acts as the gas for forcing the piston. Then, the mud clump in the piston shape is smoothly transported. Thus, the mud M is transported in the form of a clump or a similar form by the combined pressure of the vane 29 and the compressed air.

In case, however, the transportation is made difficult or stopped by some cause, the pressure upstream of the mud pipe 35 is boosted. This pressure change causes the check valve 33 to close the passage so that the mud M is prevented from flowing backward.

Figure 3:
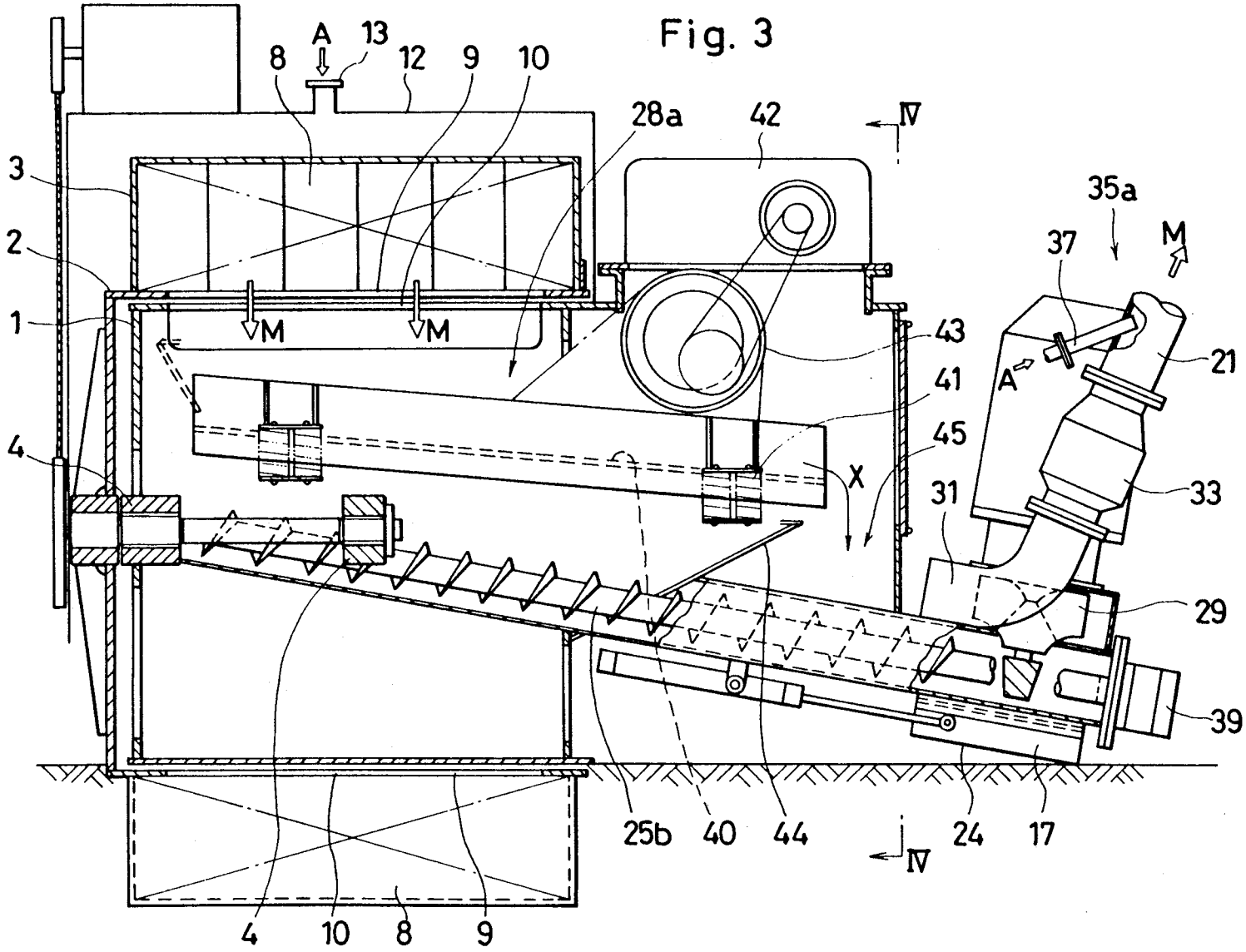
FIG. 3 is side elevation, showing a dredging apparatus according to a second embodiment of the present invention partially in a cut-away view.
Figure 4:
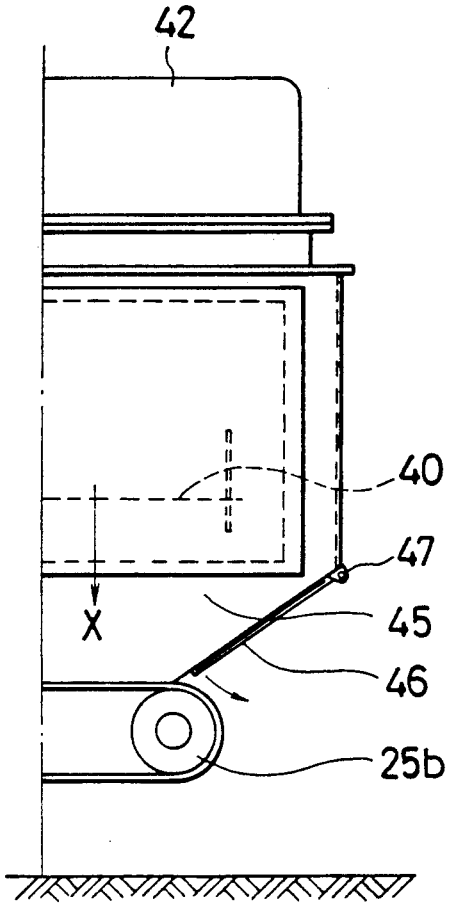
FIG. 4 is a section taken along line IV—IV of FIG. 3.

FIGS. 3 and 4 show a dredging apparatus according to the second embodiment of the present invention.

This embodiment is similar to the foregoing first embodiment with respect to the apparatus for excavating the mud M deposited on the water bottom.

This embodiment is modified from the embodiment 1 shown in FIGS. 1 and 2 in that while the obstacle separator 28 in the first embodiment is composed of the plural rollers for eliminating the obstacles such as dust between the transportation end of the screw conveyor 25 and the pressurizing vane 29, such separator 28 is replaced by another type of obstacle separator 28*a*.

This obstacle separator 28*a* screens the obstacles or foreign substances such as dust or stone in the mud M over two screw conveyors 25*b* in the mud tank 1 so that only the mud M or soil or sand may be dropped onto the screw conveyor 25*b*. Thus, the obstacle separator 28*a* is a shaking screen known generally as the low head type screen.

This obstacle separator 28*a* is constructed such that the frame of a screen 40 for dropping the mud M only is elastically supported by a spring 41, and is shaked by an oscillator 43 which is driven by a hydraulic motor 42. The mud M of soil or sand is allowed to pass through the screen 40 to the screw conveyor 25*b*. The obstacles such as dust or stone are screened off to fall, as indicated by arrow X, along the slope of the frame of the screen 40 into the collector 45 which is partitioned by a partition 44 disposed at the righthand side of FIG. 3. When the obstacles are accumulated, the operations of the separator are once interrupted so that the obstacles may be taken out by opening a cover 46, which is located at the side of the collector 45, on a hinge 47.

The operations of the apparatus thus constructed according to the second embodiment are substantially similar to those of the first embodiment shown in FIGS. 1 and 2, excepting that the obstacle separator 28*a* and the position of elimination are different. Since, in this second embodiment 2, the obstacle separator 28*a* constructed of the shaking screen 40 exhibits its agitating effect while passing the mud M therethrough, the agitating vane 11 used in the embodiment 1 can be dispensed with.

Figure 5:
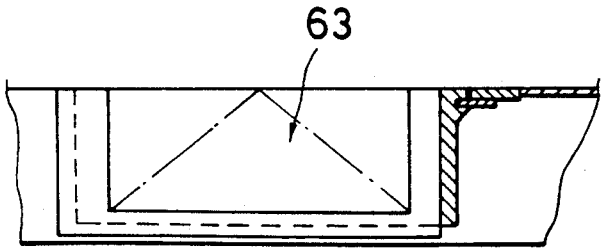
FIG. 5 is a side elevation, showing a mud transporting apparatus according to a third embodiment of the present invention.
Figure 5:
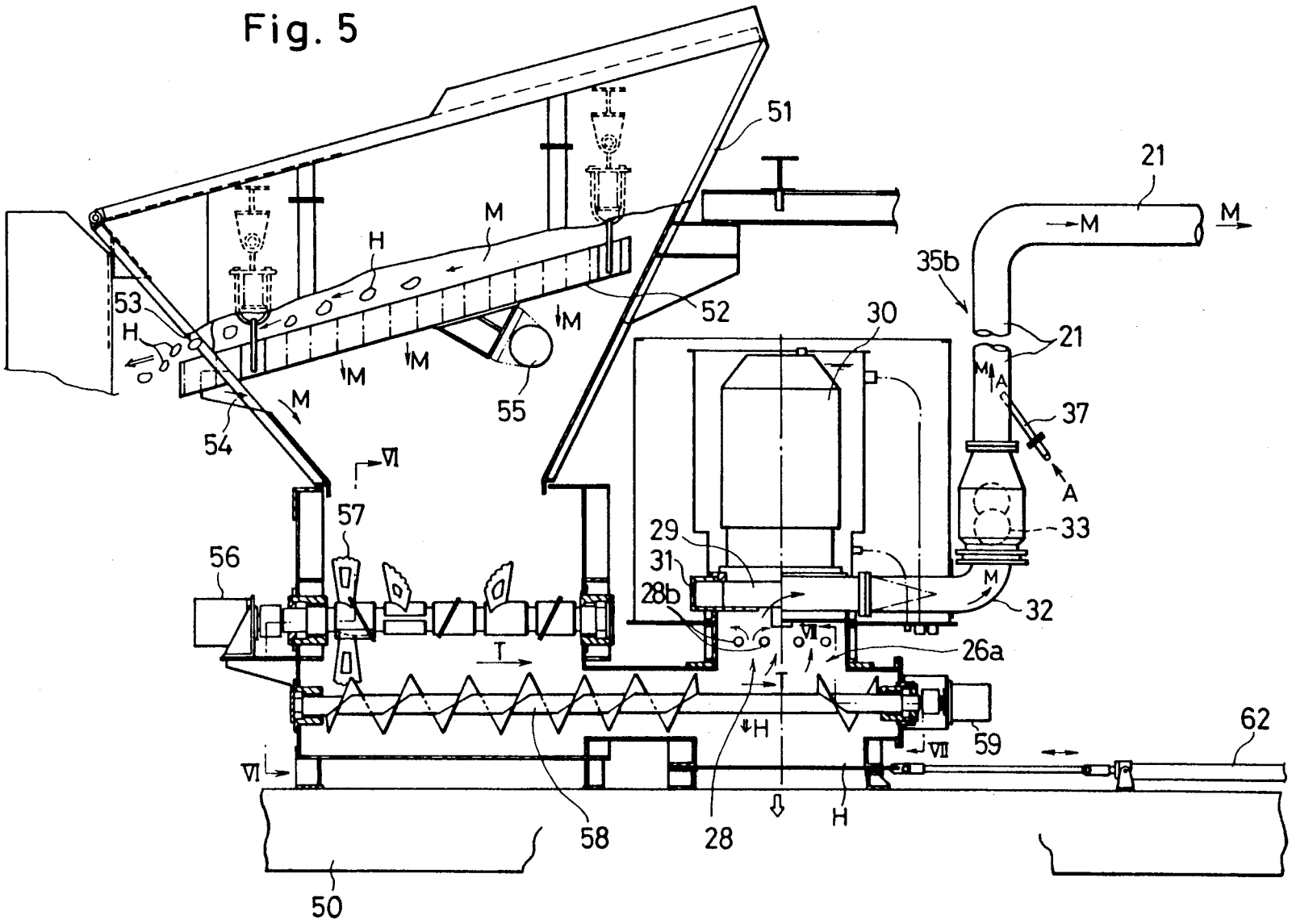

FIGS. 5, 5(*a*), 6 and 7 show a third embodiment, which is carried in its entirety on a not-shown vessel 50 to transport the mud M, which is dredged by a not-shown backhoe or glove bucket, in the direction of arrow M through the mud supply pipe 21 to a predetermined site of disposal.

In an upper part of a hopper 51 for receiving dredged mud M, there is arranged a shaking screen 52 for eliminating obstacles H such as wire, rope, sunk wood and stone from the mud M. The hopper 51 at the end of the shaking screen 52 is formed with an opening 53 for dropping the obstacles H. The shaking screen 52 is equipped below its one end with a mud receiving chute 54 for receiving the mud M to drop it below the hopper 51. Incidentally, reference numeral 55 appearing in FIG. 5 designates a hydraulic motor for driving the shaking screen 52.

Figure 6:
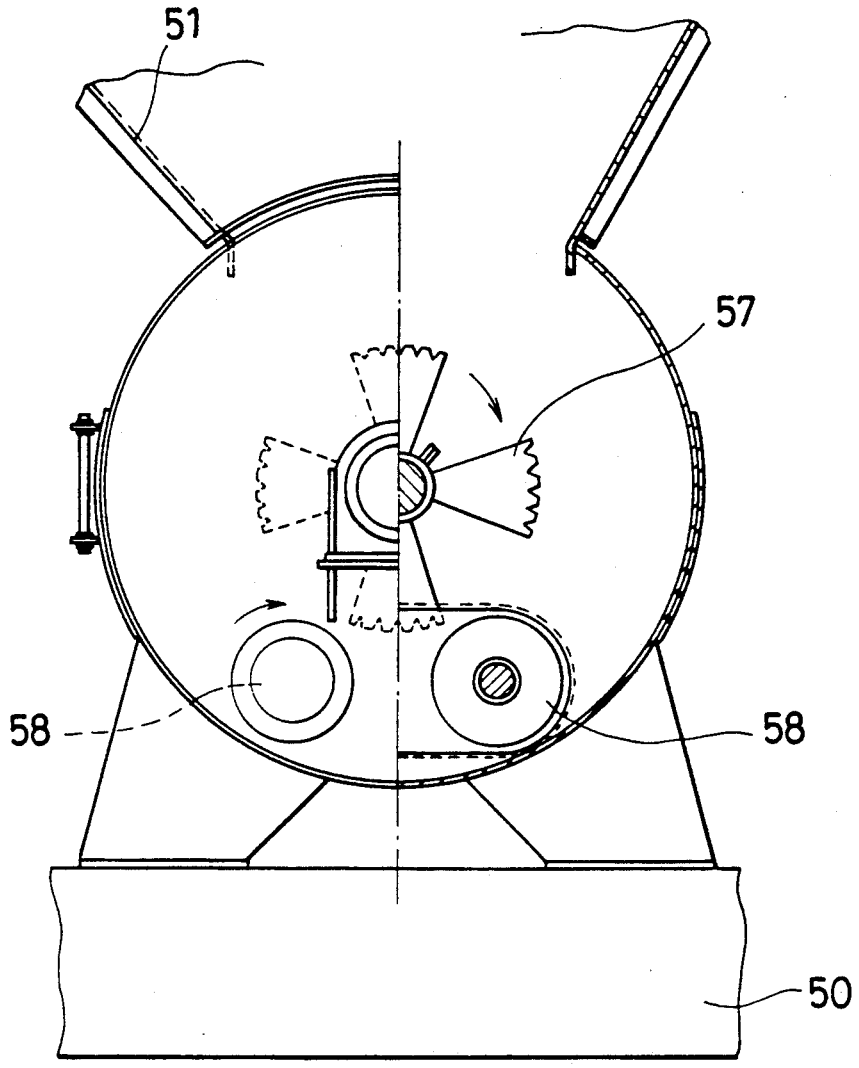
FIG. 6 is a section taken along line VI—VI of FIG. 5.

Below the hopper 51, as shown in FIGS. 5 and 6 there is arranged an agitator 57 which is rotated by an hydraulic motor 56, and below the agitator 57, two screw conveyors 58 which are rotated by a hydraulic motor 59 are disposed for conveying the mud M in the direction of arrow T.

Figure 7:
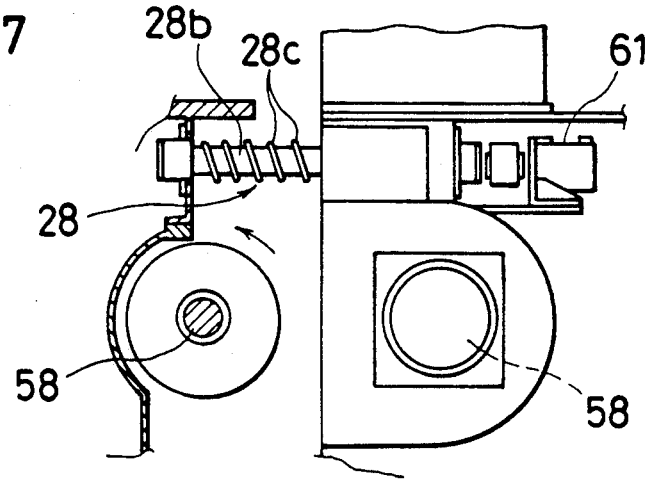
FIG. 7 is a section taken along line VII—VII of FIG. 5.

Above the output end of the screw conveyors 58, there is arranged, as another means for eliminating the obstacles H in the mud M, the obstacle separator 28 which is composed of a plurality of rollers 28*b* having spiral ridges 28*c* or grooves, as shown in FIG. 7. These rollers 28*b* are rotationally driven at a high speed by a hydraulic motor 61 to supply only the mud M from the gaps between the rollers to the pressurizing vane 29. The relatively small obstacles H such as dust left unscreened by the aforementioned shaking screen 52 are moved along the rotational direction of the ridges 28*c* out of the range of attraction of the pressurizing vane 29 until they fall down. The obstacles H having been accumulated to some extent are carried out by opening a cover 63 which is suitable opened or closed by a gate control cylinder 62. The obstacle separator 28*b* is overlaid by the spiral pressurizing vane 29 which is driven by the motor 30.

Next, to the discharge port 32 of the casing 31 accommodating the pressurizing vane 29, there is connected through the check valve 33 a mud supply portion 35*b*, which in turn is connected with the mud supply pipe 21. In this mud supply pipe 21, there is disposed the nozzle 37 for discharging the pressurized air A in the direction of transportation of the mud M, as indicated by the arrow.

The mud M transporting operations of the apparatus of the third embodiment having the structure described above will be described in the following.

If the mud M dredged by the dredger is poured into the hopper 51 shown in FIGS. 5 to 7, the relatively large obstacles H are selected by the shaking screen 52 to fall from the opening 53 to the outside of the hopper 51 until they are eliminated.

In this meanwhile, a portion of the mud M flows toward the opening 53, as indicated by arrow M, along the slope of the shaking screen 52 until it is dropped into the hopper 51 by the mud receiving chute 54.

The mud M having dropped into the hopper 51 is agitated and fluidized by the agitator 57 and transported by the screw conveyor 58 to below the pressurizing vane 29. The relatively small obstacles H in the conveyed mud M, which could not be eliminated by the shaking screen 52, are separated out, before they are attracted by the pressurizing vane 29, by the obstacle separator 28 which is composed of the plurality obstacle eliminating rollers 28*b* rotating at a high speed.

Next, the mud M is transported in the obstacle separating chamber 26*a* by the screw conveyor 58 and is attracted by the pressurizing vane 29. The mud M is then conveyed from the discharge port of the vane 29 through the check valve 33 to the mud supply pipe 21 composing the mud pipe portion 35*b*. In this pipe portion 35*b*, the mud M is transported by the compressed air A which is discharged from the nozzle 37. Thus, in the mud supply pipe 21, the mud clumps and the air are transported in a mixed form while being intermittently separated.

Figure 8:
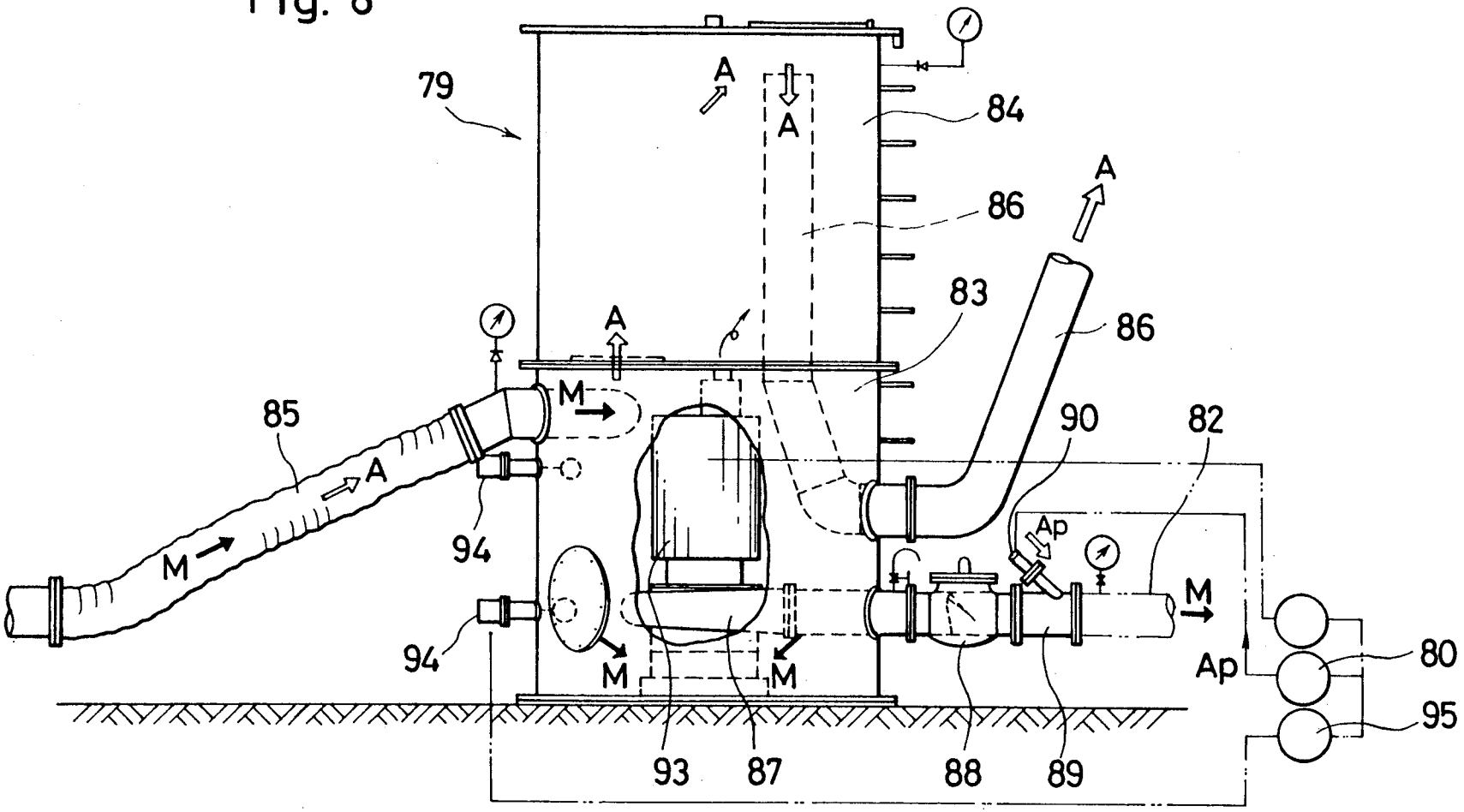
FIG. 8 is a side elevation, showing a mud transporter according to a fourth embodiment.
Figure 9:
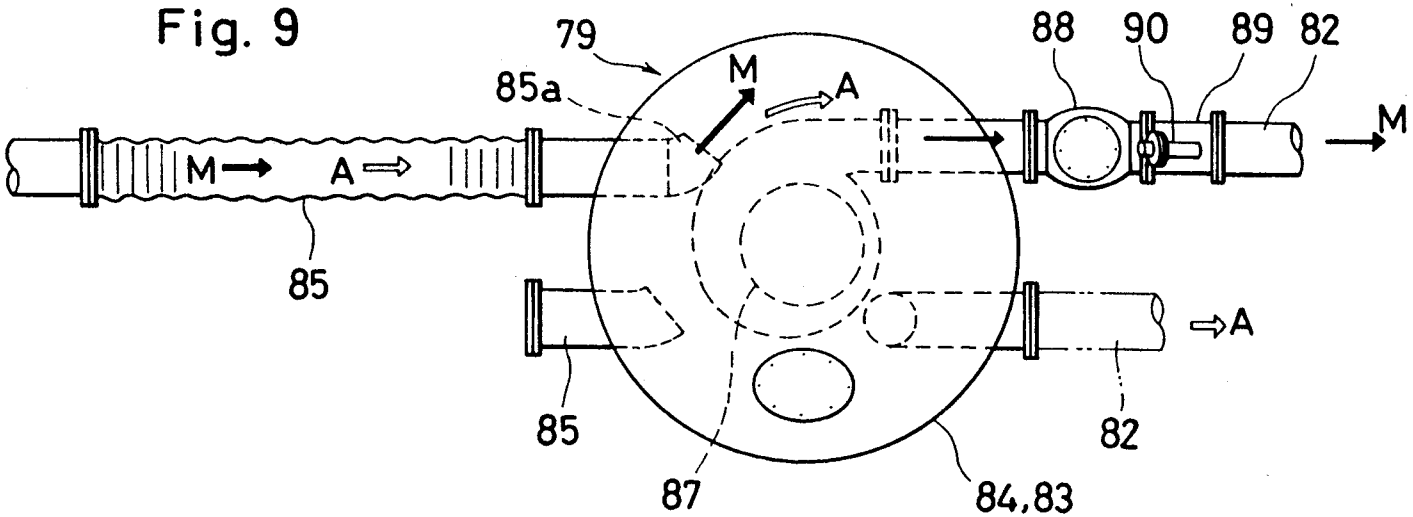
FIG. 9 is a top plan view of the same.
Figure 10:
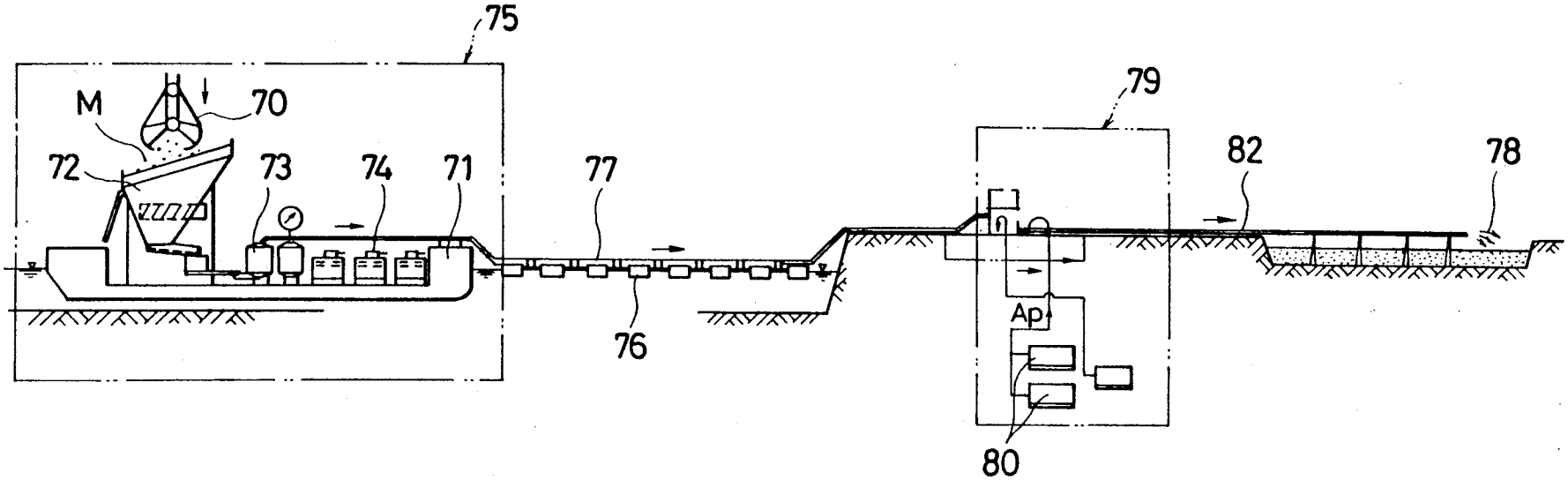
FIG. 10 is an explanatory view, showing the state in use of the mud transporter according to the fourth embodiment.

FIGS. 8, 9 and 10 show a fourth embodiment of the present invention, which provides a relay method and apparatus capable of smoothly and reliably transporting soil in the form of a soil-air mixture while a spiral pump is used.

This apparatus is a relay in case the dredged mud is to be transported in the form of a mud-air mixture. The air mixed in the mud transported in the mixture form is separated from the mud and discharged to the outside of the system so that only the mud may be sucked and pressurized by the spiral pump. When the mud is to be transported by the supply pipe, it is mixed with the pressurized air so that it may be transported in the mixture form.

In the apparatus of this fourth embodiment, as shown in FIG. 10 the mud M dredged by a glove 70 is once stored in a hopper 72 on a hull 71 and is then transported a long distance by a mud pump 73 and an air compressor 74 from a dredging vessel, as framed by two-dot-dash lines 75, through an overseas line 77 to a site 78 to be reclaimed.

The pressure established by the pumping apparatus such as the mud pump 73 and the air compressor 74 is attenuated by the resistance from the mud M during the transportation of the long distance so that it cannot convey sufficient mud. With this in mind, the mud supply pipe is equipped in its midway with a mixture transporting relay, as framed by two-dot-dash lines 79. In the pressure reducing space of the mixture transporting relay 79, the pressurized air in the mud M is once separated, and the pressurized air Ap from an air compressor 80 is mixed to establish the mud transporting pressure again to transport the mud through a mud supply pipe 82 to the site to be reclaimed.

Thus, the mixture transporting relay 79 of the present embodiment has its pressure reducing space formed of a lower tank 83 and an upper tank 84, as shown in FIGS. 8 and 9. A receiving pipe 85 for receiving the mud M having been dredged and transported in the mixture form through the overseas line 77 is connected to an upper portion of the lower tank 83 and has its end portion 85*a* formed to direct the discharge of the mud M toward the inner wall of the lower tank 83. Incidentally, two receiving pipes 85 are connected, as shown in FIG. 9, and may be of any number such as one, two or more in accordance with the situations. On the other hand, the aforementioned two tanks 83 and 84 are so formed as to facilitate the adjustment, repair and cleaning of the internal mechanism and may be united into one, as the case may be.

The upper tank 84 is equipped in its upper portion with a discharge pipe 86 having an opening, and the lower tank 83 is equipped in the center of its bottom with a spiral pump 87 having a discharge port, to which is connected through a check valve 88 a discharge pipe 89 constituting a mud supply portion. The nozzle 90 is provided for injecting the pressurized air Ap in the transporting direction of the mud M in the discharge pipe 89. The nozzle 90 injects the pressurized air Ap from an air compressor 80 into the mud M so that the mud M may be pumped in the mixture form into the mud supply pipe 82 of FIG. 10. Here, a motor 93 of the aforementioned spiral pump 87 is energized by a dynamo, and signals from level meters 94 disposed in predetermined two positions of the lower tank 83 are transmitted to a control unit 95.

If the mud M transported in the mixture form from the receiving pipe 85 flows into the mixture transporting relay 79 thus constructed, it is swirled down in the direction of arrow M in FIG. 9 along the inner wall of the lower tank 83, because the end portion 85*a* of the receiving pipe 85 has its discharge port directed toward the inner wall of the tank 83. In this meanwhile, the air A mixed in the mud M is separated from the mud M upward, as indicated by the arrow A, until it is discharged from the upper portion of the upper tank 84 through the discharge pipe 86 and further to the outside from the lower tank 83.

On the other hand, only the mud M in the lower tank 83 is sucked and transported by the spiral pump 87 and is mixed with the pressurized air Ap coming from the pressurized air injection nozzle 90 until it is transported again in the form of a soil-air mixture.

In this embodiment, the two level meters 94 are used to confirm that a predetermined amount of mud M is stored in the lower tank 83. After this confirmation, the spiral pump 87 is driven by the motor 93 to transport the mud M. Below the predetermined amount, the drive of the spiral pump 87 is interrupted. These operations are controlled by the control unit 95.

According to the present invention, the following results can be brought about.

(1) The mud dredged, agitated and fluidized is pressurized by the pressurizing vane composed of the spiral pump, and the pressurized air is supplied into the mud supply pipe connected through the check valve by the nozzle disposed at an inclination in the mud supply direction thereby to move the mud. Thus, much mud can be continuously transported.

Moreover, this mud transportation is accomplished continuously and not by the batch processing in which the mud is supplied to a plurality of tanks and pressurized by the compressed air, as in the pneumatic pumps. In addition, the mud and the pressurized air are transported in a mixed state, and the air is discharged at a small rate from the end of the mud supply pipe so that large exhaust noise is not generated unlike the prior art.

(2) The mud transported in the mixture form is discharged into the pressure reducing chamber formed in the tank so that it is released from the transporting air and purified to mud. In the case of subsequent suction into the spiral pump, only the mud can be sucked without fail to exhibit a function as the booster in the relay position for transporting the mud in the mixture form. This facilitates the transportation of the mud in the long distance.

(3) Since the pressurized air is injected through the check valve into the mud sucked and pressurized by the spiral pump, it does not flow backward to the spiral pump so that the mud can be continuously transported.

Moreover, since the mud and the pressurized air are mixed, the frictional resistance in the pipe can be reduced to drop the capacity of the spiral pump.

Furthermore, in case the mud supply pipe is clogged, this clogging can be eliminated merely by stopping the run of the spiral pump to supply only the pressurized air. Thus, the dredged mud can be efficiently transported to the site of disposal.

(4) Since the dredged mud is supplied to the spiral pump after it has been cleared of any obstacle matters, the spiral pump and the mud supply pipe can be prevented from being clogged with such obstacle substances.

What is claimed is:

1. A mud transporting method comprising the steps of: agitating and fluidizing dredged mud; pressurizing the fluidized mud by pumping said fluidized mud with a motor driven pressurizing vane and supplying said fluidized mud to a mud supply end of a mud supply pipe through a check valve; and supplying pressurized air down-stream of said check valve and in a mud transporting direction to said fluidized mud in said mud supply pipe for transporting said mud in mud clogs in said mud supply pipe with pressurized air therebetween by pneumatic force of said pressurized air.

2. A mud transporting method comprising the steps of: agitating and fluidizing dredged mud; separating solid particles contained in said fluidized mud; pressurizing said mud having said obstacles separated therefrom by pumping said fluidized mud with a motor drive pressurizing vane and supplying said pressurized mud to a mud supply end of a mud supply pipe through a check valve; and supplying pressurized air to said mud supply pipe, downstream of said check valve and in a mud transporting direction, for transporting said mud in mud clogs through said mud supply pipe with pressurized air between said clogs by the pneumatic force of said pressurized air.

3. A mud transporting method which is carried out using apparatus including a hood covering an upper half portion of a cutter wheel having buckets circumferentially arranged on a cylindrical body, said cutter wheel being rotatably supported around a cylindrical mud tank, and which comprises the steps of: supplying dredged mud and pressurized air into the interior of said hood and introducing said dredged mud and said pressurized air into said cylindrical mud tank; agitating and fluidizing said dredged mud in said cylindrical mud tank; pumping said fluidized mud with a motor driven pressurizing vane through a check valve and into a supply end of a mud supply pipe; and supplying pressurized air into said mud supply pipe downstream of said check valve and in the direction of transportation of said mud in said mud supply pipe and transporting said mud in mud clogs through said mud supply pipe, with pressurized between said clogs, with said pressurized air through said mud supply pipe.

4. A mud transporting method comprising the steps of: discharging mud and pressurized air transported through a mud supply pipe into a pressure reducing space and, in said pressure reducing space, discharging said air from said mud; sucking and pressurizing said mud, with said air discharged therefrom, in a spiral pipe; discharging said pressurized mud from said spiral pipe into a mud supply pipe through a check valve; and injecting pressurized air into said mud in said mud supply pipe downstream of said check valve for transporting said mud in mud clogs through said mud supply pipe with pressurized air between said clogs.

5. A mud transporting apparatus comprising: a tank having a built-in motor driven pump; a receiving pipe having its end portion connected to the inner wall of said tank for receiving mud transported to said tank; a discharge pipe having an opening in an upper portion of said tank; a mud supply pipe connected to said pump through a check valve; and a nozzle in said mud supply pipe downstream of said check valve for injecting pressurized air into said mud supply pipe in the direction said mud is to be transported for transporting said mud in mud clogs through said mud supply pipe with pressurized air between said clogs.

6. A highly dense dredging apparatus comprising: a cutter wheel comprising a cylindrical body having a plurality of spaced openings around the periphery thereof and excavation buckets extending outwardly from said cylindrical body and having openings opening into said openings of said cylindrical body; an open topped cylindrical mud tank disposed in said cutter wheel for receiving mud excavated by said buckets; a hood covering an upper peripheral portion of said cutter wheel and having a pressurized air supply port; a conveyor for transporting mud from the bottom portion of said tank to the outside of said tank; a pump having a pressurized vane for pumping mud conveyed by the conveyor; a mud supply pipe connected to a discharge port of said pump; a check valve in said mud supply pipe; and a nozzle in said mud supply pipe, downstream of said check valve for supplying pressurized air to said mud in said mud supply pipe at an inclination with respect to the transportation of said mud for transporting said mud in mud clogs through said mud supply pipe with pressurized air between said mud clogs.

7. A mud transporting apparatus comprising: means for agitating and conveying mud from a lower portion of a mud hopper to a pump having a motor driven pressurizing vane; a mud supply pipe connected to a discharge port of said pump; a check valve in said mud supply pipe; a nozzle connected to said mud supply line downstream of said check valve for supplying pressurized air to said mud supply pipe in a mud transporting direction for transporting said mud in mud clogs through said mud supply pipe with pressurized air between said clogs; and discharge means interposed between said hopper and said motor driven pressurized vane for discharging obstacle from said mud to be conveyed to said pressurized vane.

* * * * *